US008763422B2

(12) United States Patent
Zentner et al.

(10) Patent No.: US 8,763,422 B2
(45) Date of Patent: Jul. 1, 2014

(54) INSTANT HOT WATER DISPENSER FOR REFRIGERATOR

(75) Inventors: Martin Zentner, Prospect, KY (US); John J. Roetker, Louisville, KY (US); Mahesh Natarajan, Coimbatore (IN); Umakant Suresh Katu, Andhra Pradesh (IN); Suresh Palanki, Andhra Pradesh (IN)

(73) Assignee: General Electric Compan, Schenectady, NY (US)

( * ) Notice: Subject to any disclaimer, the term of this patent is extended or adjusted under 35 U.S.C. 154(b) by 1118 days.

(21) Appl. No.: 12/061,784

(22) Filed: Apr. 3, 2008

(65) Prior Publication Data

US 2009/0249821 A1 Oct. 8, 2009

(51) Int. Cl.
*F25D 3/00* (2006.01)

(52) U.S. Cl.
USPC ..... 62/390; 222/146.5

(58) Field of Classification Search
USPC ..... 62/389–390; 222/146.1, 146.5, 146.6; 392/465, 684, 48, 491, 493, 488; 395/465, 485, 488, 491, 493; 219/550, 219/551
See application file for complete search history.

(56) References Cited

U.S. PATENT DOCUMENTS

| | | | | |
|---|---|---|---|---|
| 2,419,273 | A * | 4/1947 | Marquette | 392/471 |
| 7,137,272 | B2 | 11/2006 | Park et al. | |
| 7,207,189 | B2 | 4/2007 | An et al. | |
| 7,439,473 | B2 * | 10/2008 | Lewin | 219/544 |
| 2002/0015585 | A1 * | 2/2002 | Jensen et al. | 392/485 |
| 2007/0251261 | A1 | 11/2007 | Son et al. | |
| 2007/0256444 | A1 | 11/2007 | Kim et al. | |

FOREIGN PATENT DOCUMENTS

| | | | |
|---|---|---|---|
| EP | 0690689 | B1 | 6/1993 |
| EP | 1299521 | B1 | 6/2006 |
| EP | 0690689 | A1 | 8/2006 |
| WO | WO9421147 | A1 | 6/1993 |
| WO | WO2005038324 | A1 | 10/2004 |
| WO | WO2006042018 | A2 | 10/2005 |
| WO | WO2006102486 | A2 | 3/2006 |
| WO | WO2007024821 | A1 | 8/2006 |

* cited by examiner

*Primary Examiner* — Cassey D Bauer
(74) *Attorney, Agent, or Firm* — Fay Sharpe LLP

(57) ABSTRACT

A refrigerator includes a main body defining a storage space therein and a door for opening and closing the storage space. The refrigerator comprises a water conduit for directing water supplied from an external water source to the main body of the refrigerator. An inlet valve distributes the water supplied from the water conduit into a hot water conduit and a separate cold water conduit. A cold water tank is mounted to one of the main body and the door for cooling the water supplied through the cold water conduit and then storing the cooled water therein. A hot water tube is mounted to one of the main body and the door for receiving the water supplied through the hot water conduit. The hot water tube includes a heater operably installed within the hot water tube and in direct contact with the water therein. The heater generates heat through the application of electric power thereto to heat the water within the hot water tube to a predetermined temperature. The hot water tube heats water on demand so that no separate hot water tank for storing hot water therein is required. A dispenser is installed on the door for dispensing the hot and cold water supplied from the hot water tube and cold water tank to the outside of the refrigerator.

12 Claims, 4 Drawing Sheets

INSTANT HOT WATER DISPENSER FOR REFRIGERATOR

BACKGROUND

The present disclosure generally relates to a hot water supplying refrigerator. More particularly, to an instant hot water dispenser for a refrigerator which heats water on demand so that no separate hot water tank for storing hot water therein is required.

A conventional refrigerator generally includes a water supplying system which supplies a user with cold water and hot water via a dispenser located on a front surface of a door thereof. The cold water and hot water are stored in separate cold water and hot water tanks mounted to the refrigerator. The dispenser, which is connected with the cold water tank and the hot water tank, generally includes a cold water lever for supplying the cold water and a hot water lever for supplying the hot water. Regarding the hot water, the conventional refrigerator includes a heater for preheating water and stores the preheated water in the hot water tank. The heater can be located within the hot water tank. To constantly maintain the temperature of water stored in the hot water tank, the heater is periodically operated or is controlled depending on a measured temperature of a temperature sensor disposed in the hot water tank. However, the hot water tank is problematic in that it cannot be properly stored in the refrigerator. The hot water tank occupies space which can be used for other purposes. Further, in order to constantly maintain the temperature of the hot water, power consumption of the refrigerator is increased.

Thus, a need exists for an instant water heating system for a refrigerator which does not require a separate hot water tank, thereby reducing power consumption of the refrigerator and improving space utilization efficiency of the refrigerator.

BRIEF DESCRIPTION

In accordance with one aspect, a refrigerator includes a main body defining a storage space therein and a door for opening and closing the storage space. The refrigerator comprises a water conduit for directing water supplied from an external water source to the main body of the refrigerator. An inlet valve distributes the water supplied from the water conduit into a hot water conduit and a separate cold water conduit. A cold water tank is mounted to one of the main body and the door for cooling the water supplied through the cold water conduit and then storing the cooled water therein. A hot water tube is mounted to one of the main body and the door for receiving the water supplied through the hot water conduit. The hot water tube includes a heater operably installed within the hot water tube and in direct contact with the water therein. The heater generates heat through the application of electric power thereto to heat the water within the hot water tube to a predetermined temperature. The hot water tube heats water on demand so that no separate hot water tank for storing hot water therein is required. A dispenser is installed on the door for dispensing the hot and cold water supplied from the hot water tube and cold water tank to the outside of the refrigerator.

In accordance with another aspect, a refrigerator includes a main body defining a storage compartment. The storage department is divided into a refrigerating compartment and a separate freezing compartment. A refrigerating compartment door opens and closes a front opening of the refrigerating compartment. A freezing compartment door opens and closes a front opening of the freezing compartment. The refrigerator comprises a water conduit which directs water supplied from an external water source to the main body of the refrigerator. An inlet valve mounted on the main body distributes the water supplied from the water conduit into a hot water conduit and a separate cold water conduit. A cold water tank is installed within the refrigerating compartment for receiving water supplied from the cold water conduit, cooling the water and then storing the cooled water therein. A hot water tube is installed within the freezing compartment door for receiving the water supplied through the hot water conduit. The hot water tube includes a heater and a support therein for supporting the heater within the hot water tube. The heater generates heat through the application of electric power thereto to instantly heat the water within the hot water tube to a predetermined temperature. A flow control valve located downstream of the hot water tube controls the flow of water through the hot water tube. A dispenser installed on the freezing door dispenses the heated water supplied from the hot water tube and the cold water supplied from the cold water tank to the outside of the refrigerator.

In accordance with yet another aspect, a method of on-demand heating of water for a refrigerator is provided. The method comprises directing water supplied from an external water source into a hot water tube mounted to one of a main body and a door of the refrigerator. A heater is installed within the hot water tube. The heater is in direct contact with the water flowing therethrough. Heat is generated through the application of electric power to the heater to heat the water flowing through the hot water tube. The flow of water through the hot water tube is restricted and controlled in order to heat the water therein to a predetermined temperature.

DETAILED DESCRIPTION

Figure 1:
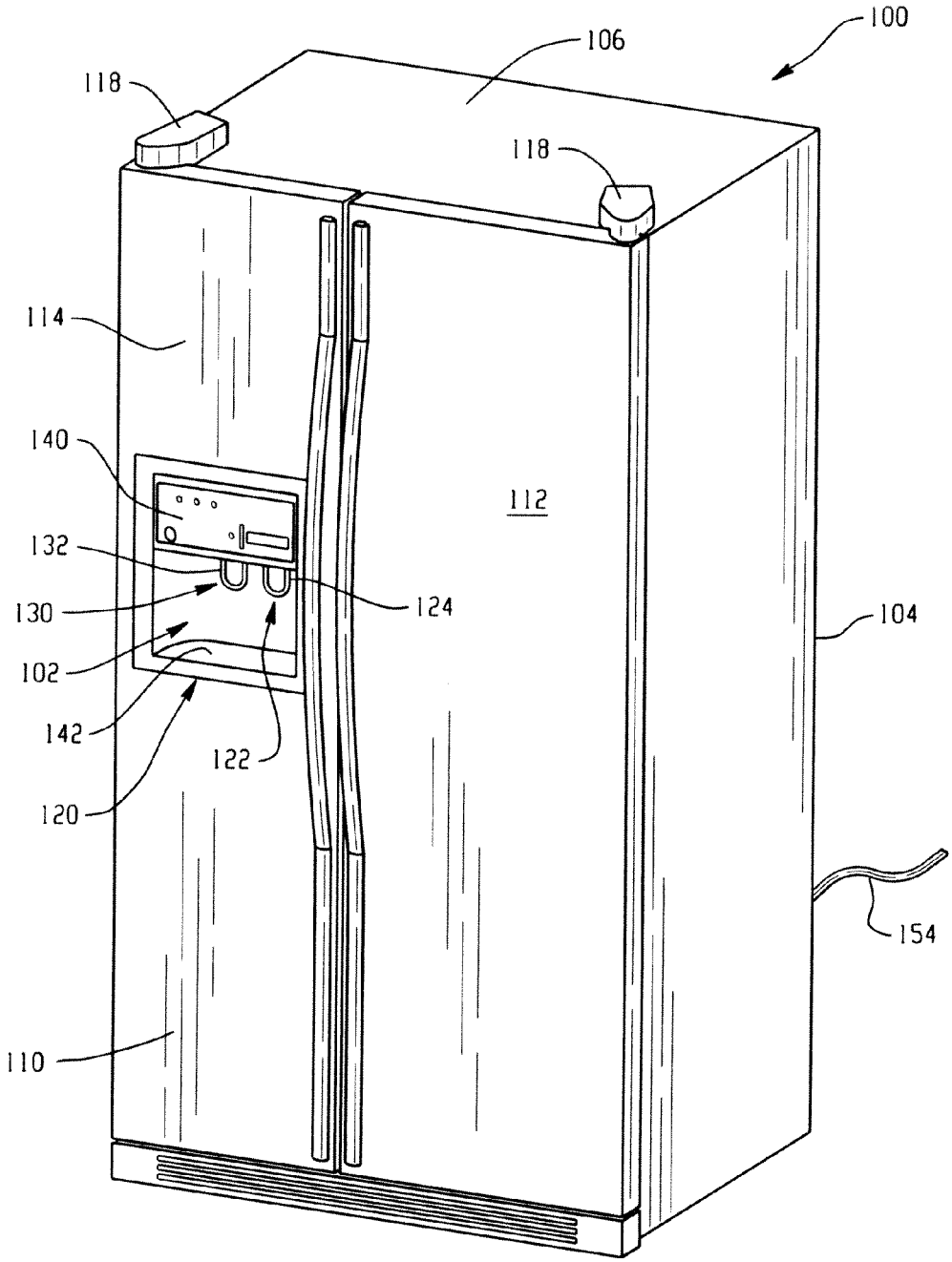
FIG. 1 is a perspective view of a refrigerator having a dispenser in accordance with the conventional art.

Referring now to the drawings, wherein like numerals refer to like parts throughout the several views, FIG. 1 illustrates a vertically formed side-by-side refrigerator 100 having a water and ice dispenser 102 installed thereon. The refrigerator includes a main body 104 which defines a storage compartment 106. The storage department is divided into a refrigerating or fresh food compartment 108 (schematically illustrated in FIG. 2) and a separate freezing compartment (not shown). In general, the freezing compartment is located at a left side of the refrigerator and the refrigerating compartment is located at a right side of the refrigerator. A door 110 opens and closes the storage compartment 106. The door is divided into a refrigerating compartment door 112 for opening and closing a front opening of the refrigerating compartment and a freezing compartment door 114 for opening and closing a front opening of the freezing compartment. An insulating layer (not shown) is formed in each of the doors. Each of the doors 112 and 114 is pivotally supported on the main body 104 of the refrigerator at a vertical side thereof by lower hinges 116 (see FIG. 4) and upper hinges 118.

The dispenser 102 is provided at one side of the refrigerator door 110, particularly on a front surface of the freezing compartment door 114. Further, a home bar, a display unit or the like may be provided on a front surface of the refrigerating compartment door 112. The dispenser includes a dispenser case 120 having a certain area and depth. A cold water faucet 122 is mounted in the dispenser 102 for supplying cold water. A cold water button or lever 124 opens and closes the cold water faucet in order to supply cold water through the cold water faucet. A hot water faucet 130 is mounted in the dispenser for supplying hot water. A hot water button or lever 132 opens and closes the hot water faucet. The dispenser also receives and dispenses ice from an ice maker. A controller 140 is mounted within the dispenser case. Function keys and a display portion are provided at the front surface of the controller. The display portion can display inputted information through the function keys, the temperatures of cold water and hot water, an operating state of the refrigerator, etc. A remaining water accommodating portion 142 for temporarily storing water leaked from the cold water faucet and the hot water faucet or dropped by a user is provided at a lower surface of the dispenser case 120. To dispense normal water or cold water, a user presses a function key on the controller, positions a cup or a container at a lower portion of the cold water faucet 122 and then presses the cold water lever 124. To dispense hot water, a user presses a function key on the controller, positions a cup or a container at a lower portion of the hot water faucet 130 and then presses the hot water lever 132.

Figure 2:
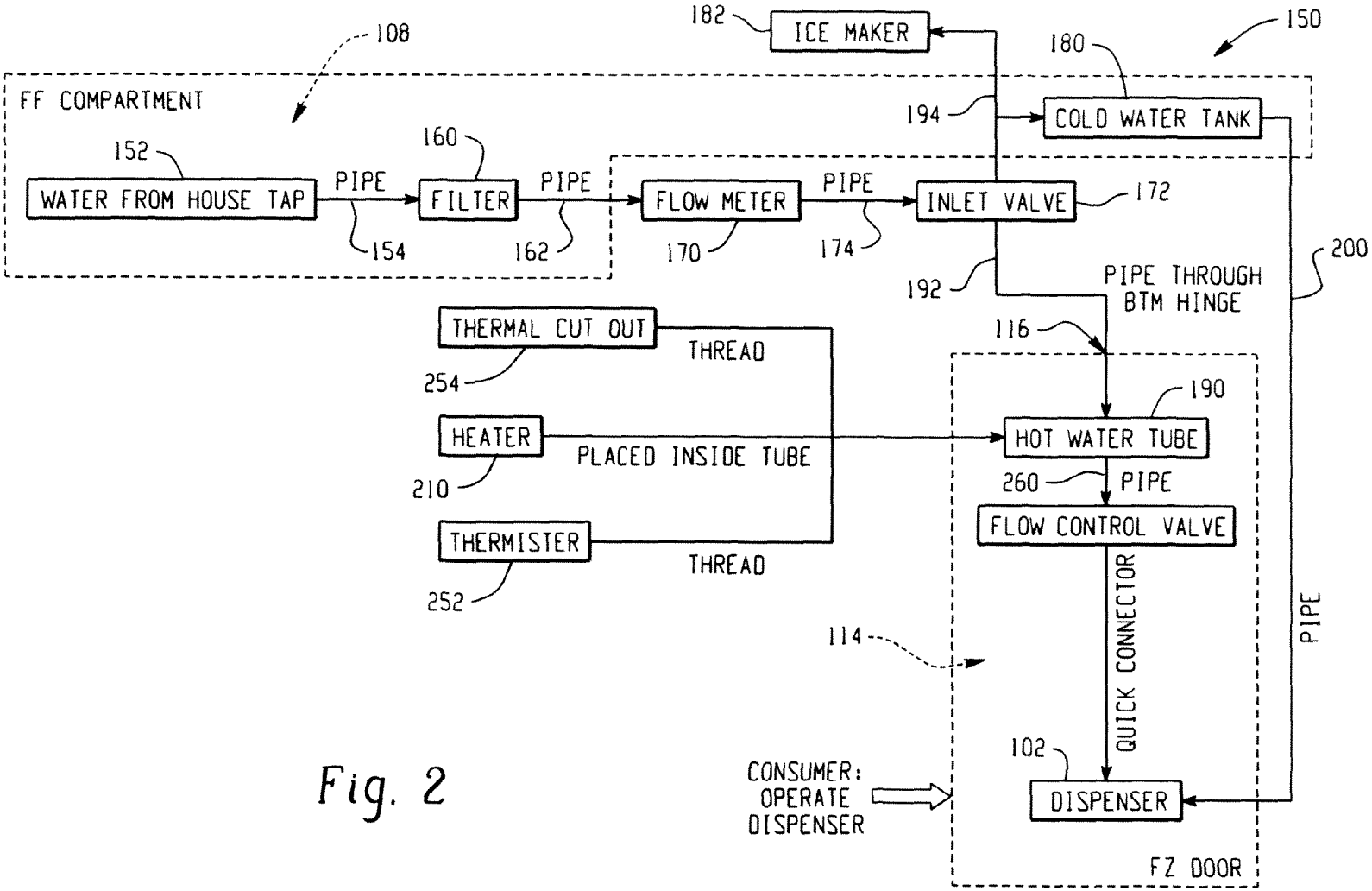
FIG. 2 is a schematic of an instant hot water dispensing system for the refrigerator of FIG. 1 in accordance with the present disclosure.

With reference to FIG. 2, a water dispensing system 150 having an instant or on demand instant hot water dispenser for the refrigerator 100 according to the present disclosure is schematically illustrated. Water is supplied into the main body 104 of the refrigerator 100 from an external cold water source 152, such as a typical house tap. To this end, the main body of the refrigerator is connected to the water source 152 through a feed tube, pipe or water conduit 154 (FIG. 1). As used herein, the terms "tube", "pipe" and "conduit" are used interchangeably and all such components or elements and their equivalents are to be considered within the scope of the present invention.

A filter 160, which is provided within the storage compartment 106 of the main body 104, is connected to the water conduit 154. A pipe 162 directs the filtered water from the filter 160 to a flow meter 170 mounted on the main body 104. As is well know, the flow meter measures the volume of water flowing through the filter to determine a need for a filter change. The flow meter can include an indicator, which can be linked to the controller 140, for signaling when the accumulated, filtered water volume reaches a threshold value and the water filter needs to be replaced.

The flow meter 170 is connected to an inlet valve 172 mounted on the main body via pipe 174. The inlet valve serves to distribute water supplied through the water conduit 154 into a cold water tank 180, an icemaker 182 and a hot water tube 190, which will be described later. Particularly, the inlet valve 172 is a three-way valve having an inlet in communication with the water conduit 154 and first and second outlets for distributing the supplied water into a hot water conduit 192 and a separate cold water conduit 194. The cold water conduit 194 supplies water to the cold water tank 180 and the icemaker 182. The hot water conduit 192 supplies water to the hot water tube 190. A separate filter (not shown) can be provided downstream of the inlet valve to filter water that will be supplied to the hot water tube.

The cold water tank 180 can be mounted to one of the main body 104 and the door 110. In the depicted embodiment, the cold water tank 180 is installed within the refrigerating or fresh food compartment 108. The cold water tank serves to lower the temperature of water supplied therein to a certain temperature or lower. An outlet of the cold water tank 180 is connected to a pipe 200 which in turn extends to the dispenser 102. A valve (not shown) can be connected to the pipe 200 for regulating the discharge of cold water from the cold water tank. Further, a separate filter (not shown) can be installed on the pipe 200 downstream of the cold water tank 180. An outlet of the pipe 200 is connected to the cold water faucet 122.

Figure 3:
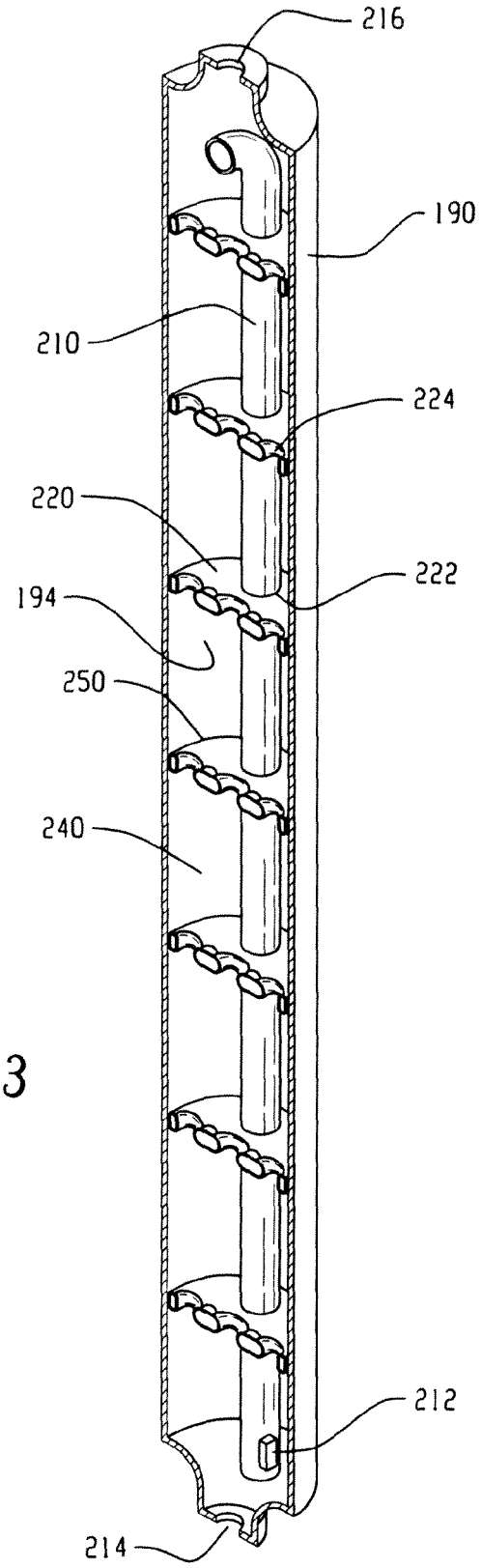
FIG. 3 is a sectional view of a hot water tube of the hot water dispensing system of FIG. 2.

With continued reference to FIG. 2, the hot water conduit 192 directs water from the inlet valve 172 to the hot water tube 190 mounted to one of the main body 104 and the door 110. In this embodiment, the hot water tube is installed within the freezing compartment door 114 and can be covered with an insulating layer within the door. As shown, a cross-sectional shape of the hot water tube is generally circular; although, alternative cross-sectional shapes, such as a polygonal shape, are to be considered within the scope of the present invention. To reduce water velocity through the hot water tube, the hot water conduit includes an inner surface defining a first diameter and the hot water tube includes an inner surface 196 defining a second, larger diameter. This feature is best illustrated in FIG. 3, which shows an inlet of the hot water tube having a diameter smaller than the second diameter.

Figure 4:
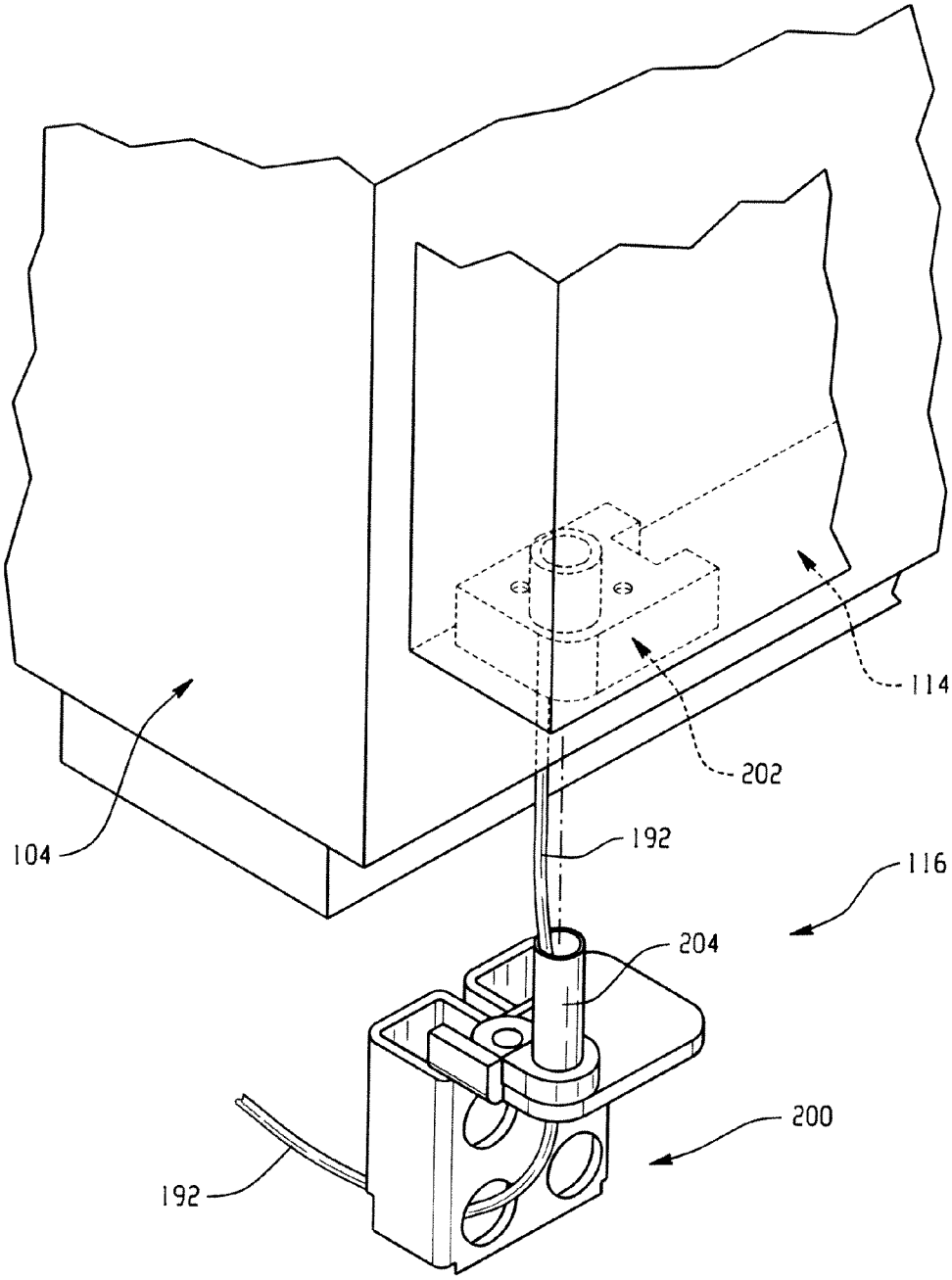
FIG. 4 is a perspective view of a bottom hinge for the refrigerator of FIG. 1.

As indicated previously, the hot water conduit 192 passes through the lower hinge 116 and extends into the freezing compartment door 114. As shown in FIG. 4, an example of the lower hinge 116 is shown. The lower hinge can include a hinge plate 200 mounted to the main body 104 and a hinge coupling 202 mounted to the door 114. The hinge plate includes a hollow hinge shaft 204 formed through to accommodate the hot water conduit 192. It should be appreciated that alternative configurations of the lower hinge are contemplated.

With reference again to FIG. 3, the hot water tube 190 includes a heater 210 operably installed therein and in direct contact with the water flowing therethrough. The heater 210 generates heat through the application of electric power thereto via an electrical connector 212 to heat the water within the hot water tube to a predetermined temperature. The direct contact with the water provides for efficient heating with less power consumption compared to an external heater because there is less loss of heat generated from the heater. The heater is a generally U-shaped coil made of a nickel chromium alloy. The coil can be rigid or flexible. Although, it should be appreciated that alternative shapes, such as an elongated rod, and materials for the heater are contemplated. The electrical connector 212 is located at an inlet 214 of the hot water tube. The heater extends from the inlet to a position adjacent a hot water outlet 216.

The length of the hot water tube 190 and heater 210 located therein can vary according to the various conditions such as the flow rate and temperature of water to be supplied. This is because the hot water tube 190 and heater 210 should be designed such that the temperature of the finally discharged hot water can be regulated to a desired value. The hot water tube 190 heats water on demand, thus, the hot water tube generally does not store water and no separate hot water tank for storing hot water therein is required for the refrigerator 100. The lack of a separate hot water tank improves space utilization efficiency of the refrigerator 100.

At least one support 220 is positioned within the hot water tube 190 and is configured to support the heater 210. In the depicted embodiment, seven spaced apart supports are provided, one being located adjacent both the inlet 214 and outlet 216 of the hot water tube; although, it should be appreciated that more of less than seven supports can positioned within the hot water tube 190. Each support 220 includes a first opening 222 dimensioned to receive the heater. In the instance where the heater 210 is generally U-shaped, each support will includes a pair of diametrically opposed first openings. Each support further includes at least one second opening 224 for allowing water to flow therethrough. As shown, the supports include three equally spaced second openings. The second openings 224 can be dimensioned to at least partially control the flow of water through the hot water tube; although, this is not required. The supports 220 divide an interior 240 of the hot water tube into separate water chambers 244. Each chamber can define a predetermined volume for heating the water flowing through that chamber to a predetermined temperature. Each support includes an outer periphery 250 in continuous contact with the inner surface 196 of the hot water tube. The supports are made of an insulating material having a high resistance to the flow of heat and charge therethrough, such as a ceramic material.

A thermistor or temperature sensor 252 and thermal cut out 254 are operable connected to the hot water tube 190. The thermistor can be mounted within the hot water tube. The thermistor measures temperature of water flowing through the hot water tube, and transmits measured information to the controller 140. The thermal cut out controls power to the heater 210. Based on the measured information, the controller can direct the thermal cut out to selectively actuate the heater.

The hot water outlet 216 of the hot water tube 190 is connected to a pipe 260 which directs the hot water to a flow control valve 262. The flow control valve regulates the discharge of hot water from the hot water tube 190 via the hot water outlet during heating. Thus, by restricting and controlling the flow of water through the hot water tube by at least the flow control valve 262 to heat water in-line, the power consumption of the refrigerator of reduced. A connector 270 connects an outlet of the flow control valve to the dispenser 102. The controller 140 can control the selectively opening and closing of the flow control valve 262.

As is evident from the foregoing, a method of on-demand heating of water for the refrigerator 100 is provided. The method comprises directing water supplied from the external water source 152 into a hot water tube 190 mounted to one of the main body 104 and the door 110 of the refrigerator. A heater is installed within the hot water tube. The heater is in direct contact with the water flowing therethrough. Heat is generated through the application of electric power to the heater to heat the water flowing through the hot water tube. The flow of water through the hot water tube is restricted in order to heat the water therein to a predetermined temperature. Thus, in use, when a consumer presses the option of normal water or cold water on the controller, the heater 210 will be in an off position. When a consumer presses the option of hot water on the controller, the heater will be actuated and the water flowing through the hot water tube 190 will be instantly heated by the heater and dispensed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A refrigerator including a main body defining a storage space therein and a door for opening and closing the storage space, the refrigerator comprising:

a water conduit for directing water supplied from an external water source to the main body of the refrigerator;

an inlet valve for distributing the water supplied from the water conduit into a hot water conduit and a separate cold water conduit;

a cold water tank mounted to the main body for cooling the water supplied through the cold water conduit and then storing the cooled water therein;

a hot water tube mounted to one of the main body and the door for receiving the water supplied through the hot water conduit, the hot water tube including a heater operably installed within the hot water tube and in direct contact with the water therein, the heater generating heat through the application of electric power thereto to heat the water within the hot water tube to a predetermined temperature, the hot water tube heating water on demand so that no separate hot water tank for storing hot water therein is required;

at least one support positioned within the hot water tube and configured to support the heater and divide an interior of the hot water tube into separate water chambers, the at least one support includes an outer periphery in continuous contact with an inner surface of the hot water tube and at least three openings being substantially equally spaced apart and the at least three opening lie upon a line in direction parallel to a diameter of the at least one support, and dimensioned to control a flow of water through the hot water tube; and a dispenser installed on the door for dispensing the hot and cold water supplied from the hot water tube and cold water tank to the outside of the refrigerator.

2. The refrigerator of claim 1, wherein the at least one support includes a first insulator located adjacent an inlet of the hot water tube and a second insulator located adjacent an outlet of the hot water tube.

3. The refrigerator of claim 1, further comprising a flow control valve located downstream of the hot water tube for restricting flow rate, and controlling the flow of water through the hot water tube and the flow of heated water to the dispenser.

4. The refrigerator of claim 1, where the heater is made of a nickel chromium alloy.

5. The refrigerator of claim 1, wherein the hot water conduit includes an inner surface defining a first diameter and the hot water tube includes an inner surface defining a second, larger diameter to reduce water velocity through the hot water tube.

6. The refrigerator of claim 1, further comprising a temperature sensor operable connected to the hot water tube and configured to sense and control temperature of the water within the hot water tube.

7. The refrigerator of claim 1, wherein the hot water conduit extends into the door through a bottom hinge of the door.

8. A refrigerator including a main body defining a storage compartment, the storage department being divided into a refrigerating compartment and a separate freezing compartment, and a door for opening and closing the storage compartment, the door being divided into a refrigerating compartment door for opening and closing a front opening of the refrigerating compartment and a freezing compartment door for opening and closing a front opening of the freezing compartment, the refrigerator comprising:

a water conduit for directing water supplied from an external water source to the main body of the refrigerator;

an inlet valve mounted on the main body for distributing the water supplied from the water conduit into a hot water conduit and a separate cold water conduit;

a cold water tank installed within the refrigerating compartment for receiving water supplied from the cold water conduit, cooling the water and then storing the cooled water therein;

a hot water tube installed within the freezing compartment door for receiving the water supplied through the hot water conduit, the hot water tube including a heater and at least one support therein for supporting the heater within the hot water tube, the heater generating heat through the application of electric power thereto to instantly heat the water within the hot water tube, the support is configured to separate the hot water tube into a plurality of chambers and having at least three openings for allowing water to flow therethrough, the at least three openings being disposed diametrically across the hot water tube, each chamber defining a predetermined volume for heating the water flowing through each chamber to a predetermined temperature;

a flow control valve located downstream of the hot water tube for restricting and controlling the flow of water through the hot water tube allowing the water to be heated to a predetermined temperature; and a dispenser installed on the freezing door for dispensing the heated water supplied from the hot water tube and the cold water supplied from the cold water tank to the outside of the refrigerator.

9. The refrigerator of claim 8, wherein the support is a ceramic insulator.

10. The refrigerator of claim 9, wherein the hot water tube includes at least two spaced apart ceramic insulators.

11. The refrigerator of claim 10, wherein each ceramic insulator includes three equally spaced openings.

12. The refrigerator of claim 8, where the heater is made of a nickel chromium alloy.

* * * * *